US005630583A

United States Patent [19]

Yergenson

[11] Patent Number: 5,630,583

[45] Date of Patent: May 20, 1997

[54] SHEET MEDIA FEEDING MECHANISM HAVING A VARIABLE RADIUS FEED ROLLER

[75] Inventor: Robin P. Yergenson, Eagle, Id.

[73] Assignee: Hewlett-Packard Company, Palo Alto, Calif.

[21] Appl. No.: 577,587

[22] Filed: Dec. 22, 1995

[51] Int. Cl.[6] ..... B65H 5/00; B65H 3/06

[52] U.S. Cl. ..... 271/119; 271/10.11; 271/270

[58] Field of Search ..... 271/119, 270, 271/10.09, 10.11, 10.12, 10.13

[56] References Cited

U.S. PATENT DOCUMENTS

| | | | |
|---|---|---|---|
| 2,394,910 | 2/1946 | Tascher | 271/119 |
| 4,232,860 | 11/1980 | Brown | 271/119 |
| 5,265,857 | 11/1993 | Chiang | 271/270 X |
| 5,326,184 | 7/1994 | Shibata | 271/119 X |
| 5,372,359 | 12/1994 | Miura et al. | 271/119 |
| 5,449,161 | 9/1995 | Gysling | 271/119 |

FOREIGN PATENT DOCUMENTS

| | | | |
|---|---|---|---|
| 140429 | 6/1986 | Japan | 271/119 |
| 138034 | 5/1990 | Japan | 271/119 |
| 313526 | 11/1992 | Japan | 271/119 |

*Primary Examiner*—Boris Milef

[57] ABSTRACT

An image forming machine, such as a printer or copier, that includes a photoconductive drum for holding a toner image and a sheet pick/feed mechanism that uses an increasing radius feed roller to vary the speed of the paper in the pick/feed and image areas. The feed roller has a substantially circumferential perimeter defined by a radius that extends out from the central rotational axis of the feed roller. The radius of the feed roller increases in magnitude between a first point on the perimeter and a second point on the perimeter. A frictionally adherent surface on the circumferential perimeter of the feed roller engages the top sheet in a stack of sheet media and moves the top sheet through the pick freed area downstream immediately adjacent to the feed roller and into the image area further downstream immediately adjacent to the photoconductive drum. The top sheet is engaged by the frictionally adherent surface at the first point on the perimeter of the feed roller. The top sheet is thereafter continuously engaged through the second point on the perimeter of the feed roller so that the speed at which the top sheet moves through the pick/feed area into the image area increases as the feed roller rotates from the first point to the second point.

1 Claim, 4 Drawing Sheets

SHEET MEDIA FEEDING MECHANISM HAVING A VARIABLE RADIUS FEED ROLLER

FIELD OF THE INVENTION

The present invention relates generally to paper or other sheet media feeding mechanisms for printers, copiers and other such image forming machines. More particularly, the invention relates to a sheet feed roller that has a variable radius to accelerate each sheet of paper through the feed zone.

BACKGROUND OF THE INVENTION

In a conventional printer, copier or other such image forming machine, sheets of paper or other sheet media are pulled from a stack and fed downstream into the print engine components where the desired image is formed on each sheet. This "pick/feed" operation is typically accomplished using a motor driven feed roller that has a frictionally adherent surface. The surface of the roller rotates against the upper surface of the top sheet in the stack to direct the top sheet into the print engine. As each sheet is picked and fed into the print engine, the desired image is being formed on a rotating photoconductive drum, typically using a scanning laser, according to print data transmitted to the printer from, for example, an attached computer. The image is thereafter transferred onto the sheet of paper as the paper passes along in contact with or very close proximity to the photoconducting drum.

To accurately transfer the image from the photoconducting drum to the paper, each sheet of paper should move through the image area immediately adjacent to the drum at a speed that corresponds to the rate of rotation of the drum. Also, the leading edge of the paper must reach the image area at the proper time so that the image is transferred accurately to the paper. In a typical laser printer, the scanning laser is positioned so that the photoconducting drum rotates between 150° to 200° before engaging the paper as the image travels from the point at which it is formed on the drum by the scanning laser to the point at which it is transferred to the paper. In conventional printers, the paper is moved at a constant speed through both the pick/feed area and the image area. Consequently, the paper must be made to move through a distance that is directly proportional to the distance the image travels along the photoconducting drum to the image area. That is, the distance between the pick/feed area and the image area is limited by the diameter of the photoconducting drum and the position of the scanning laser. The distance between the drum and the feed roller is similarly limited. For example, and using a scanner positioned 180° in advance of the image area, if the feed roller is made to engage the top sheet of paper in the stack at the same time the image is being scanned onto the photoconducting drum, then the distance between the pick/feed area and the image areas must be equal to one-half the circumference of the drum (i.e., the distance the image travels before being transferred to the paper).

In order to minimize the size and cost of the printer, it is desirable to move the pick/feed area as close as possible to the image area wherein the image is transferred from the photoconducting drum to the paper. This can be accomplished by decreasing the speed of the paper in the pick/feed area relative to the speed of the image on the photoconducting drum and then increasing the speed of the paper to match the speed of the image on the drum as the paper reaches the image area. The speed of the paper can be varied by varying the rate of rotation of the sheet feed roller. This method, however, adds complexity and cost to the printer by introducing variable speed motors, reduction gears and the like.

SUMMARY OF THE INVENTION

The present invention provides an apparatus that controls and varies the speed of the paper by varying the diameter of the sheet feed roller. The invention is directed to a sheet feed roller that has a smaller diameter portion for directing the paper more slowly through the pick/feed area and a larger diameter portion for directing the paper more rapidly into the image area. Using this increasing radius feed roller, the pick/feed area can be simply and inexpensively moved closer to the image area to reduce the size and cost of the printer. Accordingly, it is one object of the invention to minimize the size and cost of a printer, copier and other such image forming machine by allowing the pick/feed area to be moved as close as possible to the image area. It is another object of the invention to decrease the speed of the paper in the pick/feed area and increase the speed of the paper as it reaches the image area to match the speed of the image on the photoconducting drum. These and other objects and advantages are achieved by a sheet pick/feed mechanism that uses an increasing radius feed roller to vary the speed of the paper in the pick/feed and image areas. The feed roller has a substantially circumferential perimeter defined by a radius that extends out from the central rotational axis of the feed roller. The radius of the feed roller increases in magnitude between a first point on the perimeter and a second point on the perimeter. In one preferred version of the invention, the magnitude of the radius of the feed roller increases continuously between the first and second points on the perimeter of the feed roller.

Another aspect of the invention provides an image forming machine, such as a printer or copier, that includes a photoconductive drum for holding a toner image and a feed roller for moving sheet media from an input tray, wherein the sheet media are stacked, to the photoconductive drum. Again, the feed roller has a substantially circumferential perimeter characterized by a radius that extends out from the central rotational axis of the feed roller. The radius increases in magnitude between a first point on the perimeter and a second point on the perimeter. A frictionally adherent surface on the circumferential perimeter of the feed roller engages the top sheet in the stack and moves the top sheet through the pick/feed area downstream immediately adjacent to the feed roller and into the image area further downstream immediately adjacent to the photoconductive drum. The top sheet is engaged by the frictionally adherent surface at the first point on the perimeter of the feed roller. The top sheet is thereafter engaged through the second point on the perimeter of the feed roller so that the speed at which the top sheet moves through the pick/feed area into the image area increases as the feed roller rotates from the first point to the second point.

The invented sheet pick/feed mechanism and image forming machine, wherein an increasing radius feed roller accelerates the paper from a slower speed in the pick/feed area to a higher speed in the image area, allows the pick/feed area to be moved as close as possible to the image area. Thus, the feed roller can be constructed in closer proximity to the photoconductive drum to reduce the size and cost of sheet media printers.

DETAILED DESCRIPTION OF THE INVENTION

Figure 1:
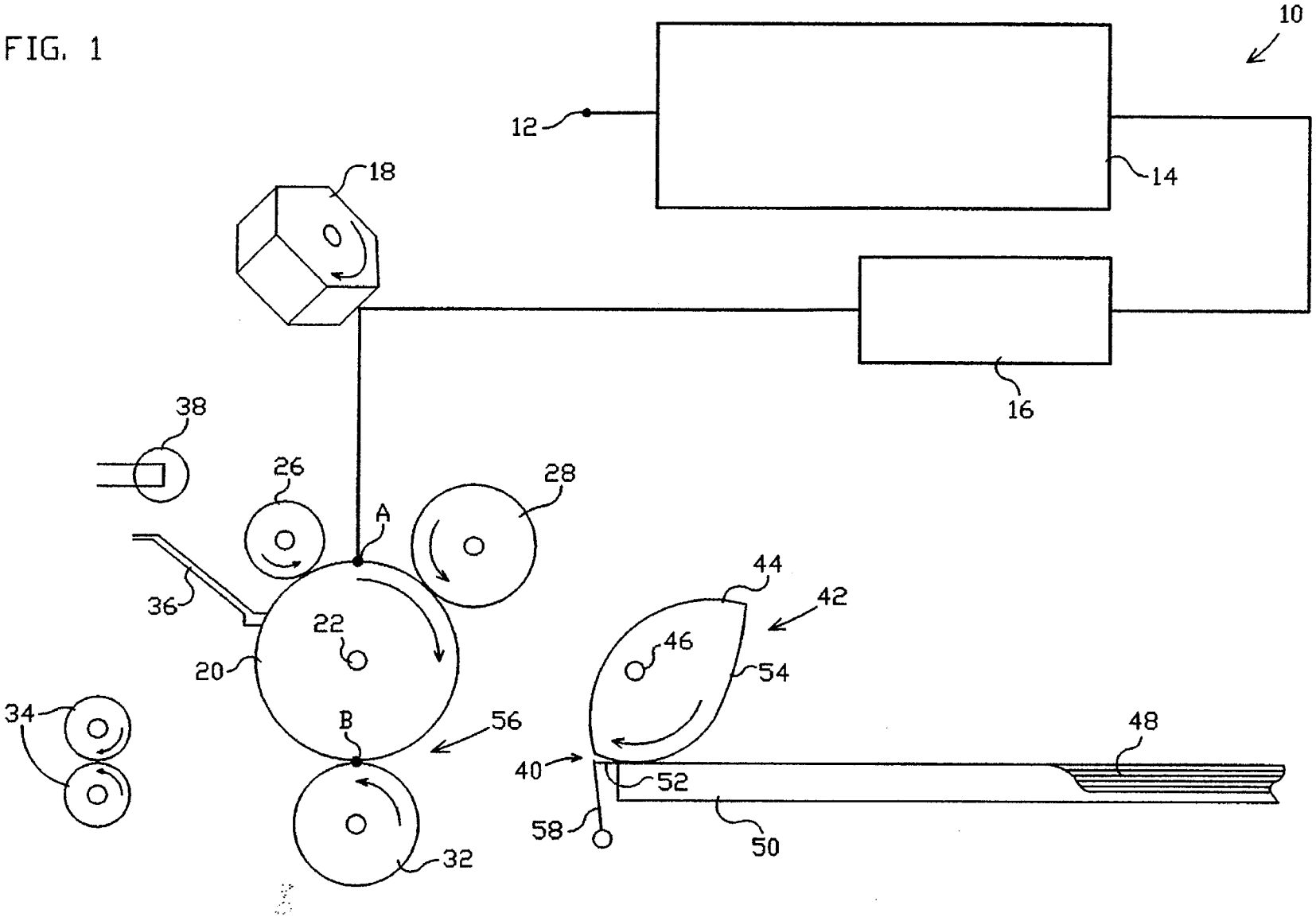
FIG. 1 is a schematic representation of a conventional laser printer adapted for use with the present invention.

FIG. 1 is a representational diagram of a conventional laser printer 10 adapted for use with the invented pick/feed mechanism. In general, a computer transmits data representing an image to input port 12 of printer 10. This data is analyzed in formatter 14, which typically consists of a microprocessor and related programmable memory and page buffer. Formatter 14 formulates and stores an electronic representation of each page that is to be printed. Once a page has been formatted, it is transmitted to the page buffer. The page buffer, usually three or more individual strip buffers, breaks the electronic page into a series of lines or "strips" one dot wide. This strip of data is then sent to a circuit that drives laser 16. Each strip of data is used to modulate the light beam produced by laser 16 such that the beam of light "carries" the data. The light beam is reflected off a multi-faceted spinning mirror 18. As each facet of mirror 18 spins through the light beam, if reflects or "scans" the beam across the side of a photoconductive drum 20. Photoconductive drum 20 rotates about a motor-driven shaft 22 such that it advances just enough that each successive scan of the light beam is recorded on drum 20 immediately after the previous scan. In this manner, each strip of data from the page buffer is recorded on photoconductive drum 20 as a line one after the other to reproduce the page on the drum.

Photoconductive drum 20 is first charged using a high voltage charging roller 26 to have a negative polarity at its surface. The light beam discharges the area on drum 20 that it illuminates. This process creates a "latent" electrostatic image on drum 20. Developing roller 28 transfers toner onto photoconductive drum 20. Typically, a dry magnetic insulating toner is used. The toner is attracted to developer roller 28 by an internal magnet. The toner particles are thereafter charged triboelectrically to have a negative polarity. Developer roller 28 is electrically biased to repel the negatively charged toner to the discharge image areas on drum 20. In this way, the toner is transferred to photoconductive drum 20 to form a toner image thereon.

The toner is transferred from photoconductive drum 20 onto paper 30 as paper 30 passes between drum 20 and transfer roller 32. Transfer roller 32 is electrically biased to impart a relatively strong positive charge to the back side of paper 30 as it passes by drum 20. The positive charge attracts the negatively charged toner and pulls it from drum 20 to form the image on paper 30. The toner is then fused to paper 30 as the paper passes between heated fusing rollers 34. The circumference of photoconductive drum 20 is usually less than the length of paper 30. Therefore, the drum must rotate several times to print a full page or sheet of paper. Drum 20 is cleaned of excess toner with cleaning blade 36, completely discharged by discharge lamps 38 and recharged by charging roller 26.

Figure 2:
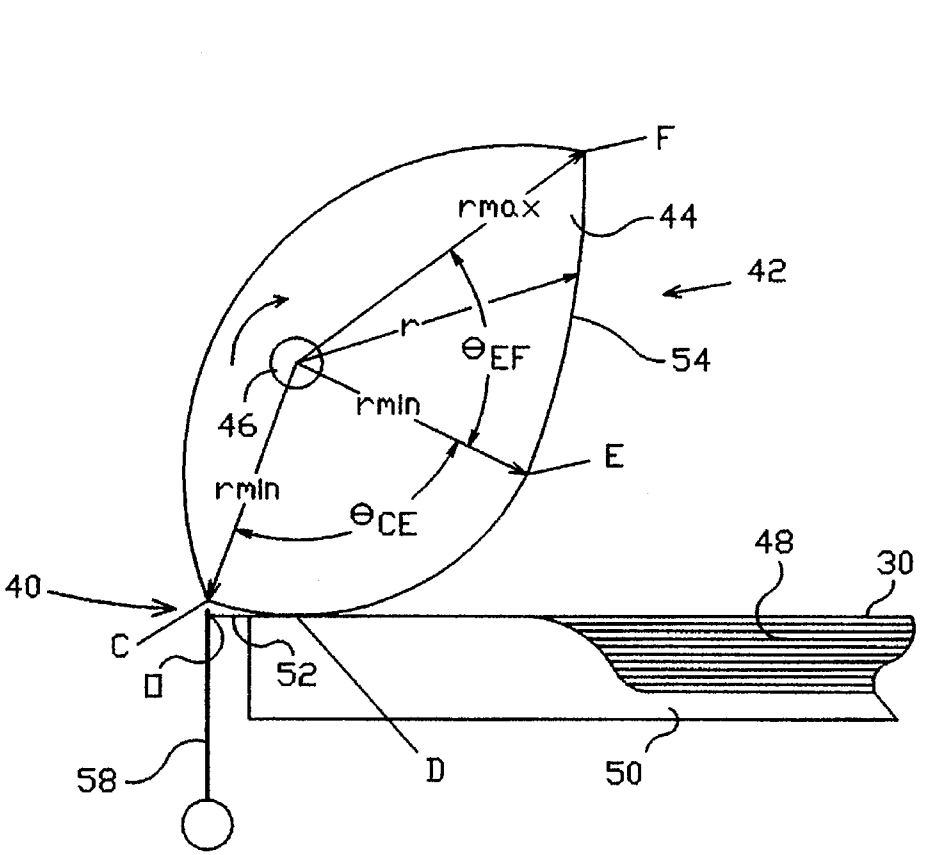
FIG. 2 is cross-sectional view of the invented pick/feed mechanism and the photoconductive drum as the leading edge of the top sheet of paper triggers scanning the image onto the photoconductive drum at the beginning of the pick/feed cycle.
Figure 2:
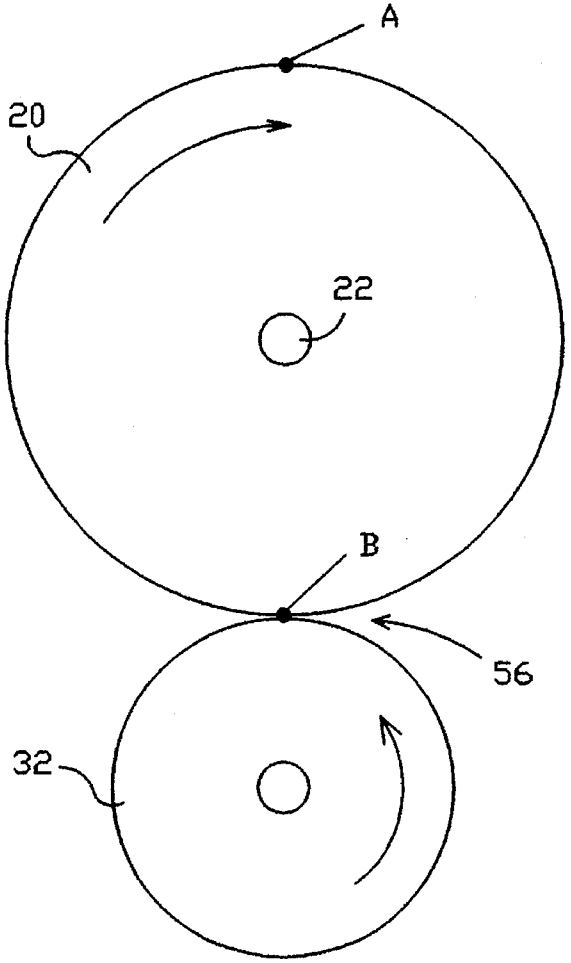
Figure 4:
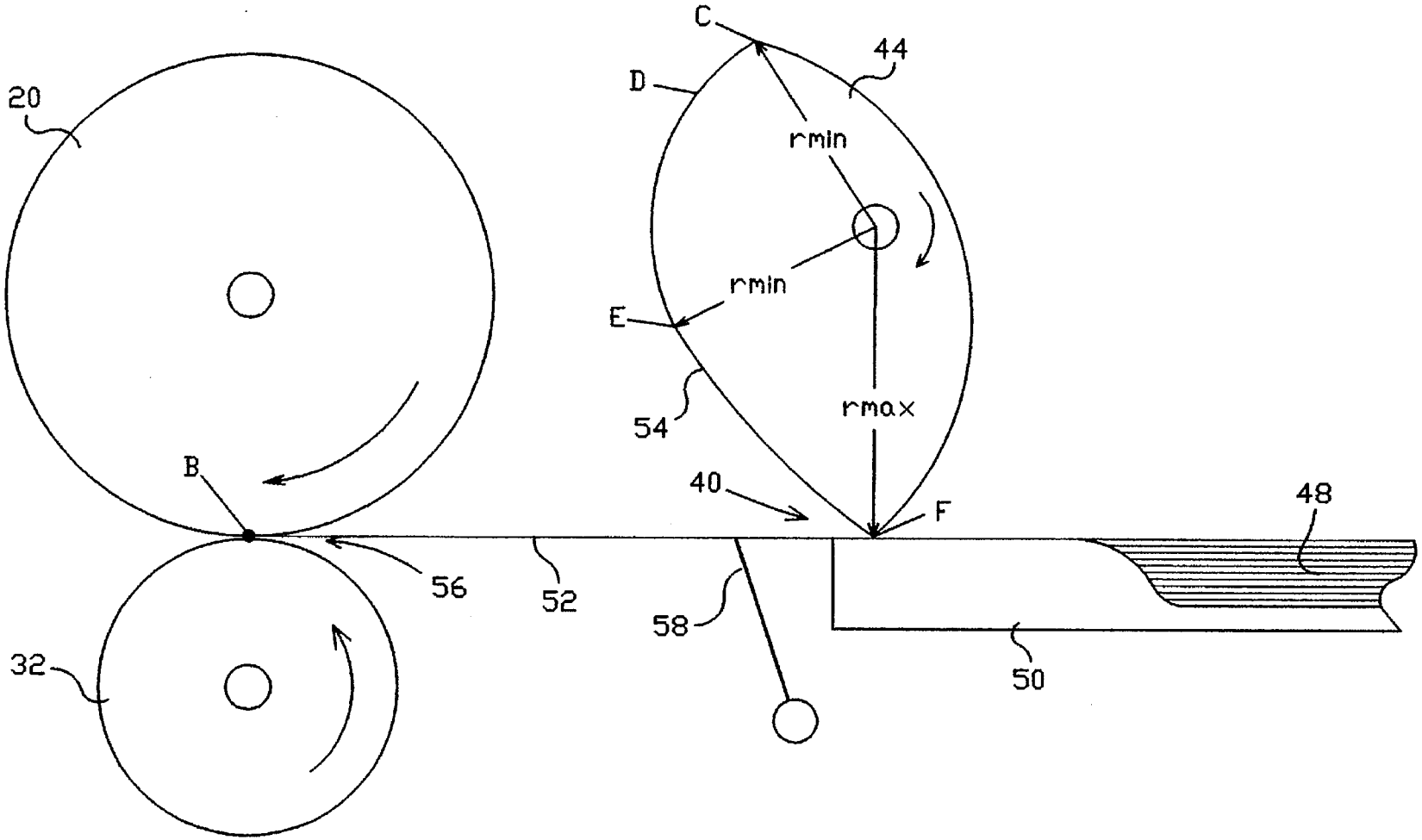
FIG. 4 is a cross-sectional view of the pick/feed mechanism and the photoconductive drum as the feed roller moves the paper into the image area.

Referring now to both FIGS. 1 and 2, each sheet of paper 30 is pulled into the pick/feed area 40 using a pick/feed mechanism 42. Pick/feed mechanism 42 includes a feed roller 44 that is operatively coupled to a motor-driven shaft 46. Feed roller 44 preferably has a generally D shaped perimeter so that feed roller 44 does not contact the paper stack between pick/feed commands. The paper stack 48 is positioned in input tray 50 to allow sliding passage of a top sheet 52 into pick/feed area 40 at the urging of feed roller 44. Feed roller 44 has a frictionally adherent outer surface 54. In operation, as feed roller 44 rotates, the frictionally adherent outer surface 54 along the circular portion of the outer perimeter of feed roller 44 contacts the upper surface of top sheet 52 and pulls it into pick/feed area 40. As feed roller 44 continues to rotate, top sheet 52 is moved through pick/feed area 40 into image area 56. As the leading edge of top sheet 52 reaches into image area 56, it is engaged between drum 20 and transfer roller 32. Feed roller 44 is preferably configured to disengage top sheet 52 as the leading edge of top sheet 52 is engaged between drum 20 and transfer roller 32, as best seen in FIG. 4. Thereafter, top sheet 52 is moved through the print engine by drum 20/transfer roller 32 and, subsequently, fusing rollers 34.

Figure 3:
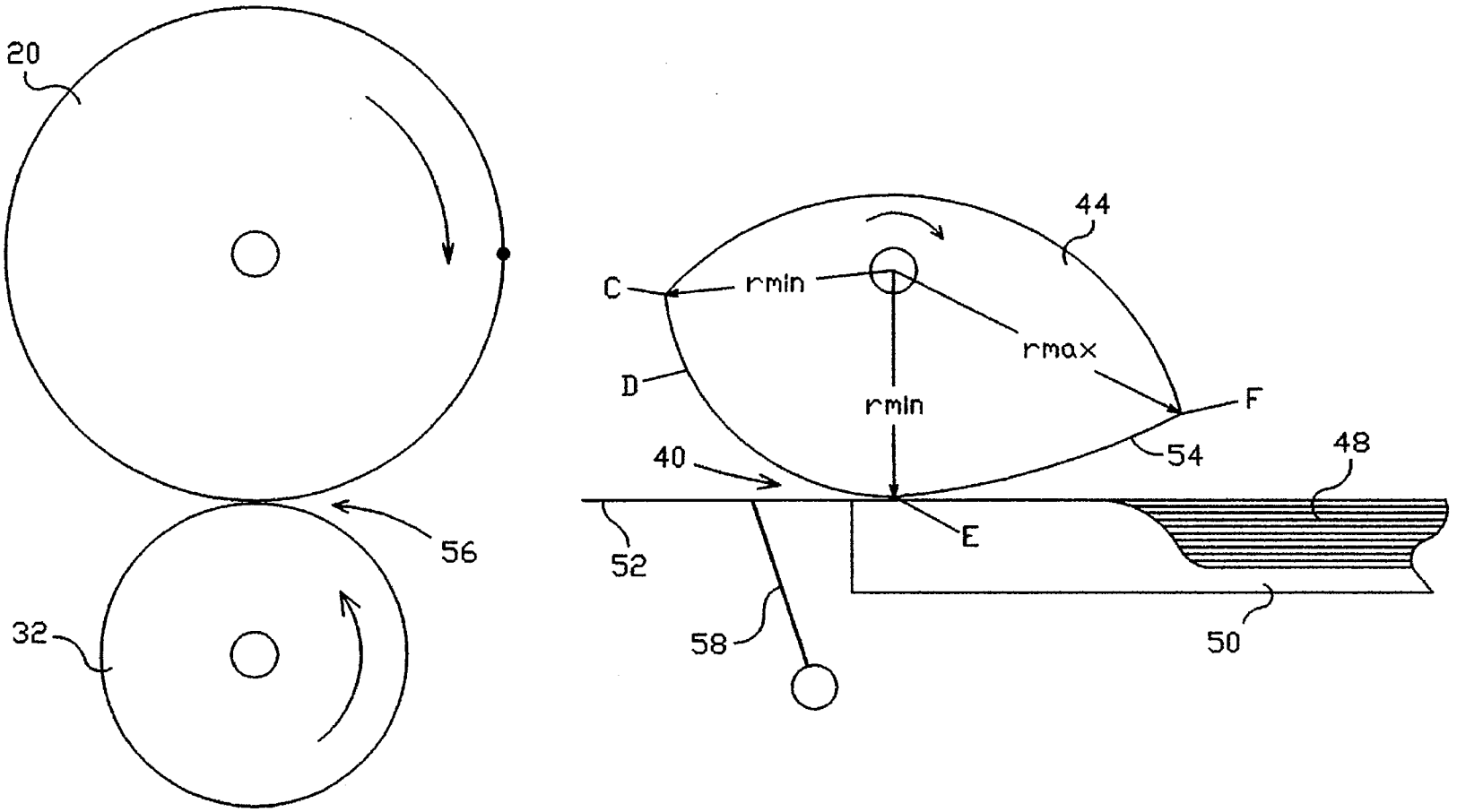
FIG. 3 is a cross-sectional view of the pick/feed mechanism and the photoconductive drum as the feed roller moves the paper through the pick/feed area toward the image area adjacent to the photoconductive drum.

Referring to FIGS. 2–4, the circular portion of the outer perimeter of feed roller 44 has a variable radius r. Feed roller radius r is smallest, designated $r_{min}$, along that portion of feed roller 44 that initially engages and moves top sheet 52 through pick/feed area 40 toward image area 56, as best shown in FIGS. 2 and 3. Radius r increases to and is largest, designated at that portion of feed roller 44 wherein top sheet 52 is moved into image area 56 where it is engaged by drum 20 and transfer roller 32. As will be apparent to those skilled in the art, input tray 50 and/or feed roller 44 may be mounted to accommodate the space change between feed roller 44 and paper stack 48 to prevent the paper from binding in the input tray as the larger diameter portion of feed roller 44 engages the paper. Feed roller radius r may be made to increase continuously or it may increase in discrete increments or steps. Preferably, maximum feed roller radius $r_{max}$ is such that top sheet 52 is moving at the same speed as the image on drum 20 when top sheet 52 reaches image area 56. In this way, the toner image held on photoconductive drum 20 can be accurately transferred to each sheet of paper 30.

One exemplary configuration of feed roller 44 will now be described with reference to FIG. 2. The radius of conductive drum 20 is 10.8 mm. Drum 20 is rotated at 2.3 radians per second (about 22 revolutions per minute). Therefore, the image on photoconductive drum 20 moves at 25 mm per second along the perimeter of the drum. The desired image is scanned onto drum 20 at point A. This image is transferred to the paper at point B, which is 180° from point A. Feed roller 44 is rotated at the rate of 1.8 radians per second (about 17 revolutions per minute) and, consequently, maximum feed roller diameter $r_{max}$ is 14 mm. The distance L between points B and O is 30 mm. Point O is the point at which the leading edge of top sheet 52 initiates scanning the desired image onto drum 20 (through leading edge sensor 58) at point A. In this example, point O is coincident with the point at which feed roller 44 releases top sheet 52. Point D is the point at which feed roller 44 engages top sheet 52 at the time the scan is triggered. The minimum feed roller radius $r_{min}$ is 10 mm. The minimum feed roller radius $r_{min}$ is maintained from point C to point E, through an angle of rotation $\theta_{C-E}$ of 76.6°. Between points E and F along the perimeter of feed roller 44 (through an angle of rotation $\theta_{E-F}$ of 63°), feed roller radius r increases from 10 mm ($r_{min}$) to 14 mm ($r_{max}$) in an Archimedean spiral defined by the equation $r=r_{min}+A\theta$, where the spiral constant A is 3.6 mm per radian (0.06 mm per degree).

Other configurations are possible. Scanning may be initiated before or after the pick/feed command is given. The point at which the image is scanned onto drum 20 and the relative size and spacing of the components may be different from that shown and described. The magnitude of $r_{min}$, the angle through which it rotates and the rate at which it increases to $r_{max}$ is dependent on the distance P between point A (the point at which the image is scanned onto drum 20) and point B (the point at which the image is transferred to top sheet 52), the desired distance L between point B and point O (the position of the leading edge at the initiation of the scan), and the respective rates of rotation of drum 20 and feed roller 44. In general, feed roller radius r can be determined according to the following equations.

$t_P=t_L$, where $t_P$ is the time it takes the image initially scanned onto the photoconductive drum to travel distance P from point A to point B, and $t_L$ is the time it takes the leading edge of the top sheet to travel distance L from point O to point B.

$t_P=P/V_{image}=P/(\omega_{drum}\times r_{drum})$, where $V_{image}$ is the rate at which the image travels on the perimeter of the photoconductive drum.

$t_L=t_{D-E}+t_{E-F}+t_{D-O}$, where $t_{D-E}$, $t_{E-F}$, and $t_{D-O}$, are the times, respectively, it takes the leading edge of the top sheet to travel the distances between points D and E, E and F, and D and O on feed roller 44.

$$t_{D-E}=DE/(\omega_{roller}\times r_{min}).$$

$$t_{E-F}=EF/(\omega_{roller}\times r),\text{ where } r=r_{min}+A\theta.$$

$$t_{D-O}=DO/(\omega_{roller}\times r_{max}),\text{ where } r_{max}=r_{min}+A\theta_{EF}.$$

$$L=DE+EF+CD.$$

While the present invention has been shown and described with reference to the foregoing preferred embodiment, it will be apparent to those skilled in the art that other forms and details may be made thereto without departing from the spirit and scope of the invention as defined in the appended claims.

What is claimed is:

1. An image forming machine, comprising:

a. a photoconductive drum for holding a toner image;

b. a rotatable feed roller for moving sheet media from an input tray. wherein the sheet media are stacked, to the photoconductive drum:

c. the feed roller having a perimeter that engages individual sheet media and throughout the period of engagement continuously advances the individual sheet media, the perimeter characterized by a radius that extends out from a central rotational axis of the feed roller, the radius increasing in magnitude in the direction of rotation between a first point on the perimeter and a second point on the perimeter;

d. a frictionally adherent surface on the perimeter of the feed roller;

e. the input tray disposed adjacent to the feed roller so that, upon rotation of the feed roller, the frictionally adherent surface engages a top sheet in the stack and moves the top sheet through a pick/feed area downstream immediately adjacent to the feed roller and into an image area further downstream immediately adjacent to the photoconductive drum; and f. wherein the top sheet is engaged by the frictionally adherent surface at the first point on the perimeter of the feed roller and the top sheet is thereafter engaged through the second point on the perimeter of the feed roller so that the speed at which the top sheet moves through the pick/feed area into the image area increases as the feed roller rotates from the first point to the second point.

* * * * *